US010173420B2

(12) United States Patent
Wong et al.

(10) Patent No.: US 10,173,420 B2
(45) Date of Patent: Jan. 8, 2019

(54) PRINTHEAD ASSEMBLY

(71) Applicant: HEWLETT-PACKARD DEVELOPMENT COMPANY, L.P., Houston, TX (US)

(72) Inventors: Wai Mun Wong, Singapore (SG); Leong Yap Chia, Singapore (SG); Ning Ge, Palo Alto, CA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/558,618

(22) PCT Filed: Jul. 30, 2015

(86) PCT No.: PCT/US2015/042908
§ 371 (c)(1),
(2) Date: Sep. 15, 2017

(87) PCT Pub. No.: WO2017/019091
PCT Pub. Date: Feb. 2, 2017

(65) Prior Publication Data

US 2018/0134037 A1 May 17, 2018

(51) Int. Cl.

| | |
|---|---|
| ***B41J 2/05*** | (2006.01) |
| ***B41J 2/16*** | (2006.01) |
| ***B41J 2/14*** | (2006.01) |

(52) U.S. Cl.
CPC ..... *B41J 2/05* (2013.01); *B41J 2/14072* (2013.01); *B41J 2/14129* (2013.01); *B41J 2/16* (2013.01); *B41J 2202/03* (2013.01); *B41J 2202/11* (2013.01)

(58) Field of Classification Search
CPC ..... B41J 2/05; B41J 2/14072; B41J 2/14129; B41J 2/16
See application file for complete search history.

(56) References Cited

U.S. PATENT DOCUMENTS

| | | | |
|---|---|---|---|
| 4,931,813 | A | 6/1990 | Pan et al. |
| 7,780,270 | B2 | 8/2010 | Lee et al. |
| 8,246,147 | B2 | 8/2012 | Tamura et al. |
| 8,366,952 | B2 | 2/2013 | Anderson et al. |
| 8,511,796 | B2 | 8/2013 | Ghozeil et al. |
| 2005/0012791 | A1 | 1/2005 | Anderson et al. |
| 2008/0115359 | A1 | 5/2008 | Guan et al. |
| 2009/0094834 | A1 | 4/2009 | Bell et al. |
| 2009/0309932 | A1 | 12/2009 | Kim et al. |

(Continued)

OTHER PUBLICATIONS

Wuu, et al. Structural and electrical properties of Ta—Al thin films by magnetron sputtering Wuu, D-S. et al. Apr. 1999.

*Primary Examiner* — Bradley Thies
(74) *Attorney, Agent, or Firm* — HP Inc. - Patent Department

(57) ABSTRACT

The present subject matter relates to a printhead assembly comprising a plurality of print nozzles in a nozzle array. Each of the plurality of print nozzles is coupled to a printhead firing resistor, the printhead firing resistor being individually addressable. A print control circuit is to actuate the printhead firing resistor. In accordance with one example implementation of the present subject matter, the print control circuit comprises pull-down resistors made of Tantalum-Aluminum (Ta—Al).

15 Claims, 6 Drawing Sheets

(56) References Cited

U.S. PATENT DOCUMENTS

2010/0302293 A1 12/2010 Torgerson et al.
2013/0063527 A1* 3/2013 Ge ..... B41J 2/14056
347/63

* cited by examiner

PRINTHEAD ASSEMBLY

BACKGROUND

Thermal inkjet printers include a printhead assembly having an array of nozzles that confronts a print medium. A resistive heating element is located adjacent to each nozzle in the array of nozzles. Momentary heating of a resistive heating element produces an ink bubble in the ink in the vicinity of a nozzle. The ink bubble is propelled through the adjacent nozzle towards the print medium to print a picture element or pixel.

Generally, an electronic controller of a thermal inkjet printer generates print control signals based on the data to be printed. The print control signals trigger one or more resistive heating elements to print the data on the print medium.

BRIEF DESCRIPTION OF FIGURES

The detailed description is described with reference to the accompanying figures, wherein.

DETAILED DESCRIPTION

Figure 1:
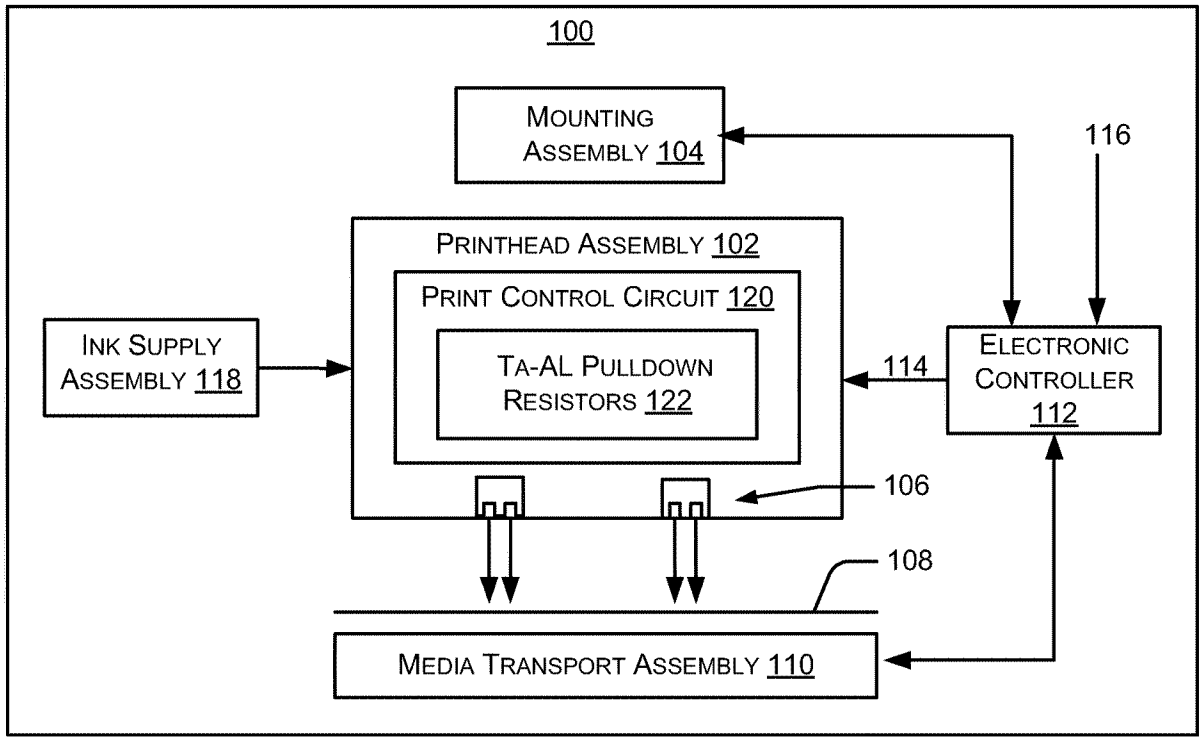
FIG. 1 illustrates a printing system, in accordance with one example implementation of the present subject matter.

Printhead assemblies used in thermal inkjet printers generally comprise numerous functional components. For example, a printhead assembly of a thermal inkjet printer may comprise components, such as nozzle arrays, and memory arrays along with circuitries that decode signals from an electronic controller of the thermal inkjet printer to actuate the nozzle arrays and the memory arrays. The numerous functional components and the intricate interconnections between them, results in the printhead assemblies having a complex structure. The complexity is further enhanced owing to the fact that the printhead assemblies are made as compact as possible to occupy minimum space in thermal inkjet printers that incorporate the printhead assemblies.

Generally, a printhead assembly is a thin film structure fabricated using a semiconductor substrate having various thin film layers formed thereon. Fabrication of a printhead assembly is carried out using integrated circuit processing techniques, such as lithographic etching and deposition techniques.

Manufacturers of printhead assemblies consistently explore ways to make the printhead assemblies compact and to make the fabrication process cost effective. A natural recourse to make the printhead assemblies compact is to make the components of the printhead assemblies, fabricated on the semiconductor substrate, smaller in size. However, the reduction in size of the components may not only adversely impact the performance of the printhead assembly but may also result in making the fabrication process unduly complicated.

In accordance with one example implementation of the present subject matter, a printhead assembly comprising pull-down resistors made of Tantalum-Aluminum (Ta—Al) and a printhead integrated circuit having pull-down resistors fabricated of a Ta—Al thin film layer are described.

In an example, the printhead assembly comprises a nozzle array having a plurality of print nozzles. Each of the print nozzles is coupled to a printhead firing resistor which is individually addressable. The printhead assembly further comprises a print control circuit to actuate the printhead firing resistor based on print control signals received from an electronic controller. The print control circuit comprises pull-down resistors made of Ta—Al to set the level of the print control signals at a predefined logic level when the print control circuit is in a high impedance state.

The printhead integrated circuit comprises, among other layers, a Ta—Al layer disposed on a semiconductor substrate. The Ta—Al layer is discontinuous and comprises at least a first Ta—Al layer portion and a second Ta—Al layer portion. In an example, the first Ta—Al layer portion forms a pull-down resistor while the second Ta—Al layer portion forms a printhead firing resistor.

Accordingly, in an example implementation, the pull-down resistors which are otherwise generally fabricated of polysilicon layer having a sheet resistivity of about 300/sq, are made of a Ta—Al layer which has a sheet resistivity of about 600/sq, thus resulting in about 50% reduction in area of the semiconductor substrate usually occupied by the pull-down resistors. In another example implementation, a Ta—Al layer having a sheet resistivity of about 1200/sq may be used, thus providing about 75% reduction in the area. Further, the reduction in area does not impose additional complexity on the fabrication process since the Ta—Al layer is already an existing layer in a printhead integrated circuit, wherein the printhead firing resistors are made of the Ta—Al layer.

The above discussed printhead assemblies and integrated circuits are further described in the figures and associated description below. It should be noted that the description and figures merely illustrate the principles of the present subject matter. It will thus be appreciated that various arrangements that embody the principles of the present subject matter, although not explicitly described or shown herein, can be devised from the description and are included within its scope.

FIG. 1 illustrates an inkjet printing system 100, in accordance with one example implementation of the present subject matter. The inkjet printing system 100 includes a printhead assembly 102, mounted on the mounting assembly 104 that supports the printhead assembly 102. The printhead assembly 102 includes at least one printhead die, also referred to as a printhead integrated circuit (not shown) that includes a plurality of print nozzles 106 which, when actuated, eject ink on a print medium 108, such as paper or cloth.

The inkjet printing system 100 includes a media transport assembly 110 to move the print medium 108 relative to the mounting assembly 104 that holds the printhead assembly 102. The print nozzles 106 eject ink in a sequenced manner to print various characters, symbols, pictures and so on as the printhead assembly 102 and the print medium 108 move relative to each other.

An electronic controller 112 synchronizes the relative movement of the printhead assembly 102 and the print medium 108. The electronic controller 112 also generates print control signals 114 that actuate one or more nozzles 106 in accordance with the data 116 to be printed. The electronic controller 112 may be an application-specific integrated circuit (ASIC) implemented to control various functions of the inkjet printing system 100.

As generally understood, each nozzle 106 is an opening of a vaporization chamber that contains ink supplied by an ink supply assembly 118 of the inkjet printing system 100. A printhead firing resistor (not shown) resides in vicinity of each print nozzle 106. When the printhead assembly 102 is operated to print data 116, printhead firing resistors of the printhead assembly 102 are momentarily heated in a selective manner. The heating of a printhead firing resistor heats the ink in proximity of the printhead firing resistor and causes an ink bubble to be formed. The ink bubble forces the ink to eject through the print nozzle 106 on the print media 108.

Generally, the printhead firing resistors are made up of Tantalum-Aluminum (Ta—Al). Ta—Al exhibits properties, such as high sheet resistivity, good heat dissipation, ability to withstand high temperature and ability to withstand impact from the ink bubbles that collapse to expel ink on the print media 108. Accordingly, printhead firing resistors made up of Ta—Al provides optimum life before getting corroded due to oxidation at high temperature.

Actuation of the Ta—Al printhead firing resistors is controlled by the print control signals 114 generated by electronic controller 112. A print control circuit 120 is implemented on the printhead assembly 102 to decode print control signals 114 and to selectively actuate the printhead firing resistors.

In accordance with one example implementation of the present subject matter, the print control circuit 120 comprises one or more pulldown resistors 122 made of Ta—Al. The pulldown resistors 122 set the level of the print control signals 114 at a predefined logic level when the print control circuit 120 is in a high impedance or floating state. For example, in situations when the printhead assembly 102 is connected to the electronic controller 112 but is not performing a printing operation, there may be a voltage appearing at nodes of the printhead assembly 102 that connect the printhead assembly 102 to the electronic controller 112 to receive the print control signals 114. The voltage causes the electronic controller 112 to unpredictably interpret the nodes to be in a logical high or logical low state. The pulldown resistors 122 allow this voltage to be drained to bring the level of the print control signals 114 at a low logic, for instance, ground potential to enable the electronic controller 112 to interpret the status of the nodes correctly.

Figure 2:
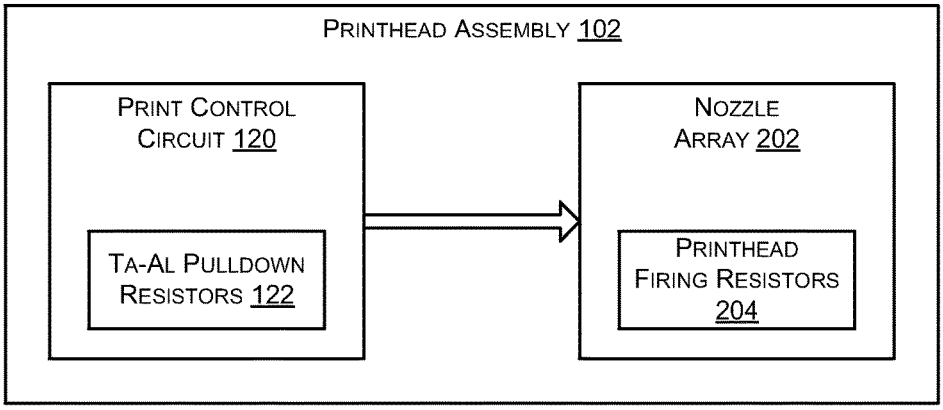
FIG. 2 illustrates an inkjet printhead assembly according to an example of the present subject matter.

Reference is made to FIG. 2 for more details of the print control circuit 120 and pulldown resistors 122. FIG. 2 illustrates the printhead assembly 102, according to an example of the present subject matter. The printhead assembly 102 comprises a nozzle array 202 fabricated in the printhead assembly 102. The nozzle array 202 comprises the plurality of print nozzles 106 arranged in rows and columns. As mentioned above, each of the plurality of print nozzles 106 is coupled to a printhead firing resistor 204. Thus, each printhead firing resistor 204, being associated with a print nozzle 106 also forms an array and is individually addressable based on selection of corresponding row and column.

The print control circuit 120 actuates the printhead firing resistors 204 based on the print control signals 114 it receives from the electronic controller 112. The print control circuit 120 comprises pull-down resistors 122 made of Ta—Al. In an example, the Ta—Al pull-down resistors 122 replace the polysilicon pull-down resistors generally incorporated in printhead assemblies. Ta—Al having a high sheet resistivity, on one hand, provides for the Ta—Al pull-down resistors 122 to be made compact and, on the other hand, imposes no additional complexity in the fabrication process of the printhead assembly 102 since the fabrication process already includes fabrication of a Ta—Al thin film layer for fabricating the printhead firing resistor 204.

Figure 3:
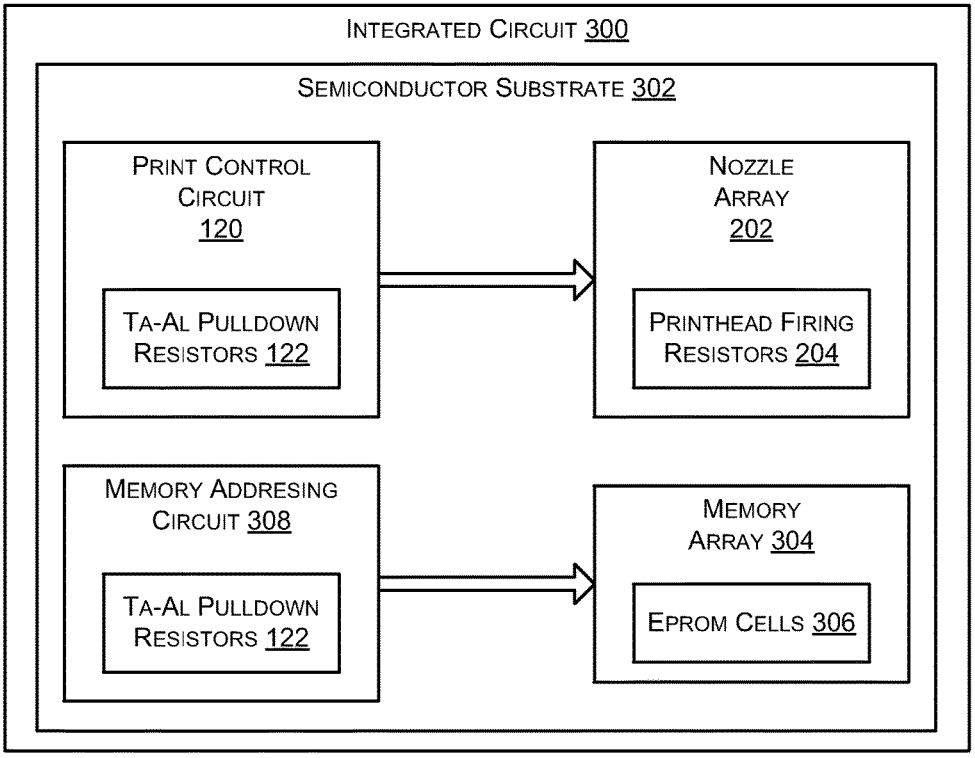
FIG. 3 illustrates an integrated circuit for a printhead assembly, in accordance with one example implementation of the present subject matter.

The Ta—Al pull-down resistors 122 also replace polysilicon pull-down resistors associated with one or more memory arrays included in the printhead assembly 102. This is described in reference to FIG. 3 that illustrates an integrated circuit 300 for the printhead assembly 102, also referred to as the printhead integrated circuit 300, in accordance with one example implementation of the present subject matter.

In an example implementation, the printhead integrated circuit 300 is a thin film structure fabricated using a semiconductor substrate 302 having various thin film layers formed thereon. In the example implementation illustrated in FIG. 3, at least one nozzle array 202 comprising printhead firing resistors 204 is fabricated on the semiconductor substrate 302. The print control circuit 120 is formed on the semiconductor substrate 302 to provide firing control signals to the printhead firing resistors 204 based on the print control signals received from the electronic controller 112. As mentioned previously, the print control circuit 120 comprises pull-down resistors 122 made of Ta—Al to set a level of each of the print control signals at a predefined logic level when the print control circuit is in a high impedance state.

In addition to the nozzle array 202, a memory array 304 may also be fabricated on the semiconductor substrate 302. The printhead integrated circuit 300 comprises the memory array 304 to store information retrievable by the electronic controller 112 of the inkjet printing system 100 to which the printhead integrated circuit 300 may be coupled during operation. For example, characteristics of a print cartridge of the printhead assembly 102 may be stored in the memory array 304 such that the same is identifiable by electronic controller 112 to adjust the operation of the inkjet printing system 100 and ensure correct operation. The memory array 304 comprises erasable programmable read-only memory (EPROM) cells 306 formed on the semiconductor substrate 302.

A memory addressing circuit 308 is fabricated on the semiconductor substrate 302 to perform read and write operations on the EPROM cells 306 based on a memory control signal received from the electronic controller 112. In an example implementation of the present subject matter, the memory addressing circuit 308 comprises one or more Ta—Al pull-down resistors 122, to set a level of the memory control signal at a predefined logic level when the memory addressing circuit 308 is in the high impedance state. Further details of the pull-down resistors 122 to set the level of the memory control signal and the print control signals 114 is explained in details with reference to FIG. 4.

Figure 4:
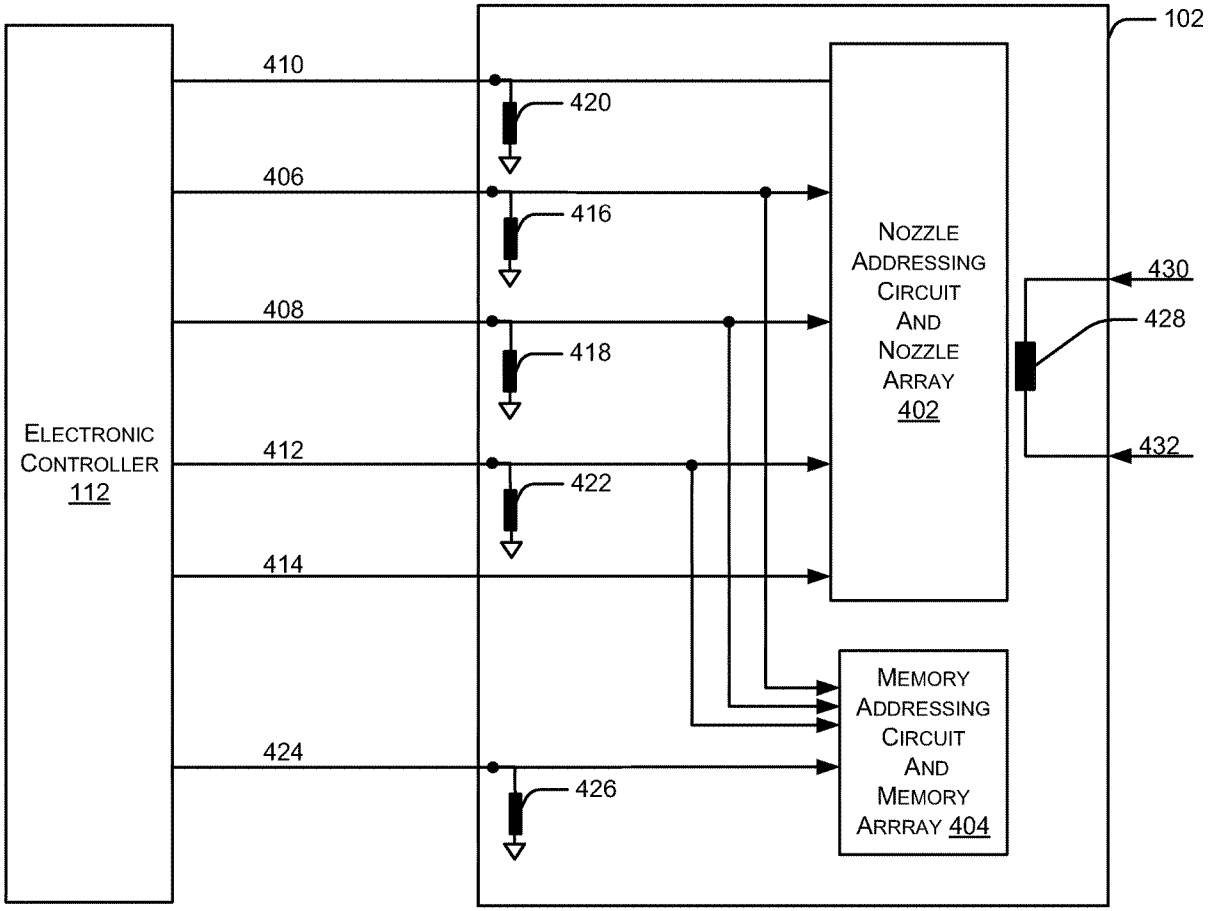
FIG. 4 illustrates the printhead assembly according to another example of the present subject matter.

FIG. 4 illustrates the printhead assembly 102 according to another example of the present subject matter. For simplicity of representation, the print control circuit 120, interchangeably referred to as nozzle addressing circuit hereinafter is depicted together with the nozzle array 202 as nozzle addressing circuit and nozzle array 402. Similarly, the memory addressing circuit 308 together with the memory array 304 is shown as memory addressing circuit and memory array 404. Further, in the example implementation illustrated in FIG. 4, the previously mentioned Ta—Al pull-down resistors 122 of the print control circuit 120 and the memory addressing circuit 308 have been depicted to be coupled to the nozzle addressing circuit and nozzle array 402 an the memory addressing circuit and memory array 404.

The Ta—Al pull-down resistors 122, in one example, include pull-down resistors 416, 418, 420, 422 and 426 as shown in FIG. 4. The pull-down resistors 416, 418, 420, 422 and 426 are to set the level of the print control signals 114 and the memory control signal. In an example, the print control signals 114 comprise a select signal 406, data signal 408, synchronization signal 410 and clock signal 412 as explained below.

For data 116 to printed, the printhead firing resistors 204 receive firing energy from a plurality of fire lines 414 on the printhead assembly 102. The plurality of fire lines 414 have herein been depicted as a single fire line 414 for simplicity. The select signal 406 is provided to selectively enable those printhead firing resistors 204 that are to be actuated based on the data 116 to be printed. According to one example of the present subject matter, at least one of the pull-down resistors 122, hereinafter referred to as the select pull-down resistor 416, is to set the level of the select signal 406 to the predefined logic level when the nozzle addressing circuit and nozzle array 402 is in the high impedance state. In an example, depending on design considerations, the select pull-down resistor 416 may have a resistance of about 10-100KΩ.

In operation, to print data 116, the nozzle array 202 is enabled based on the select signal 406. Further, the data signal 408 which, among other things, is representative of the data 116 to be printed is provided to the printhead assembly 102. To elaborate, before a print operation can be performed, the data 116 is sent to printhead assembly 102 from electronic controller 112. The electronic controller 112 receives the data 116 from a host, such as a computer device and provides the same to the printhead assembly 102, for example, in the form of a bitmap. In an example of the present subject matter, at least one of the pull-down resistors 122, also referred to as the data pull-down resistor 418, is to set the level of the data signal 408 to the predefined logic level when the nozzle addressing circuit and nozzle array 402 is in the high impedance state. The data pull-down resistor 418 may have a resistance of about 40KΩ in an example.

The print nozzles 106 are actuated based on the data 116 to be printed. Thus, the printhead firing resistors 204 are triggered sequentially in accordance with the data 116. The synchronization signal 410 enables sequential addressing of the printhead firing resistors 204, each of which is individually addressable. In one example, at least one of the pull-down resistors 122, also referred to as the synchronization pull-down resistor 420, is to set the level of the synchronization signal 410 to the predefined logic level when the nozzle addressing circuit and nozzle array 402 is in the high impedance state. In an implementation, the synchronization signal 410 may have a resistance of about 40KΩ.

The printhead assembly 102, alike any electronic circuitry, operates based on the clock signal 412 provided by the electronic controller 112. In an example implementation, at least one of the pull-down resistors 122, interchangeably referred to as the clock pull-down resistor 422, may be used to set the level of the clock signal 412 to the predefined logic level when the nozzle addressing circuit and nozzle array 402 is in the high impedance state. In an example implementation, the clock pull-down resistor 422 may have a resistance of about 40KΩ.

The select signal 406, data signal 408, and clock signal 412 are also provided to the memory addressing circuit and memory array 404. These signals, along with the previously mentioned memory control signal, herein depicted as memory control signal 424, enable operations of the EPROM cells 306. The memory control signal 424, also known as the ID signal 424 is connected to the EPROM cells 306 and provides for reading/programming of the EPROM cells 306. The ID signal 424 selectively initiates those EPROM cells 306 that are to be programmed or read and prevents other EPROM cells 306 on the same line from being programmed and/or read. In one example, one of the pull-down resistors 122, is associated with the memory array 304 to set the level of the ID signal 424 at the predefined logic level when the memory array 304 is in the high impedance state. The pull-down resistor 122 associated with the memory array 304 is also made of Ta—Al and is referred to as the ID pull-down resistor 426. In one example, depending on the design of the printhead assembly 102, the ID pull-down resistor 426 may have a resistance of about 100KΩ.

When the printhead assembly 102 is not in use, there can be a voltage appearing at nodes of the printhead assembly 102 that connect the printhead assembly 102 to the electronic controller 112 to receive the select signal 406, data signal 408, synchronization signal 410, clock signal 412, and ID signal 424. This voltage is drained to avoid situations, for example, where status of a node, whether high or low, becomes non-deterministic. The pull-down resistors 122, namely, the select pull-down resistor 416, data pull-down resistor 418, synchronization pull-down resistor 420, clock pull-down resistor 422, and ID pull-down resistor 426 have one end connected to the respective nodes and the other connected to ground. Accordingly, the pull-down resistors 122 drain the extra current and bring down the voltage level of the respective signals to the optimum level. Also, the pull-down resistors 122 prevent the chances of enabling the print control circuit 120 because of noise or other disturbance when power supply to the printhead assembly 102 is disconnected.

In one example implementation, the printhead assembly 102 comprises a thermal sense resistor 428 having a pair of electrical contacts known as thermal sense resistor contact 430 and thermal sense resistor return contact 432. The thermal sense resistor 428 is a resistor of known magnitude implemented on printhead assembly 102 while the electrical contact 430,432 are on the inkjet printing system 100 to which the printhead assembly 102 is coupled. The thermal sense resistor 428 changes its value according to the temperature and helps in monitoring the temperature of inkjet printing system 100. In an example, the thermal sense resistor 428 is made of aluminum copper (Al—Cu) because of its temperature sensing properties.

Figure 5:
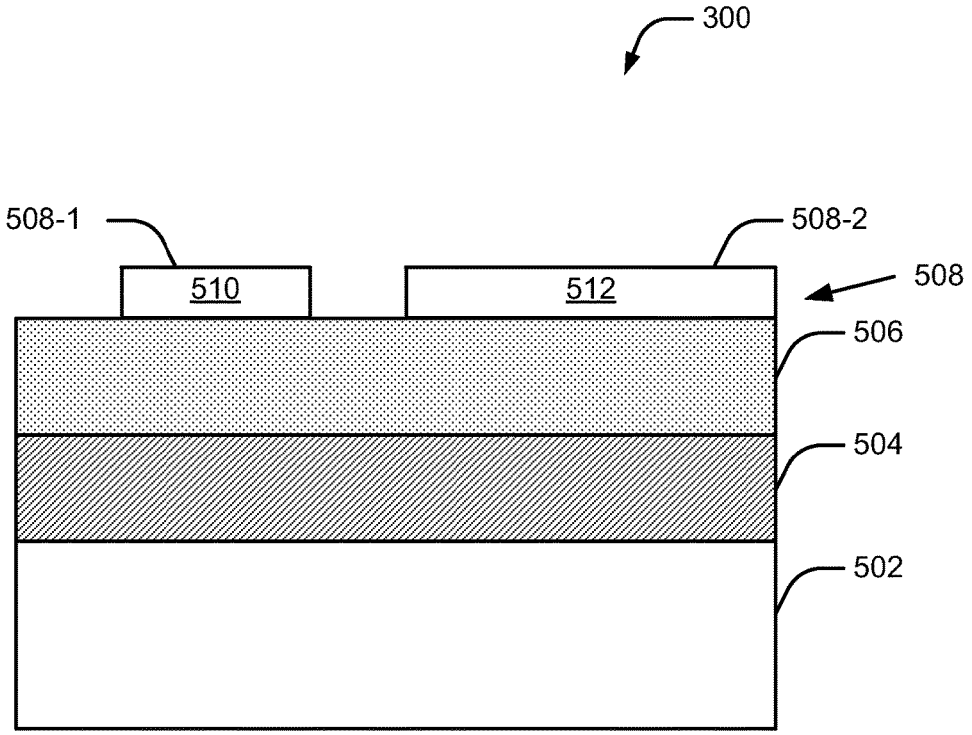
FIG. 5 illustrates a cross-sectional view depicting various layers of the printhead integrated circuit, in accordance with one example implementation of the present subject matter.

Reference is now made to FIG. 5 that shows a cross-sectional view depicting various layers of the printhead integrated circuit 300, in accordance with one example implementation of the present subject matter.

In an example, the printhead integrated circuit 300 comprises a semiconductor substrate layer 502. The semiconductor substrate layer 502 may comprise, for instance, a silicon substrate. Further, in one example, the semiconductor substrate layer 302 may have a thickness of about 675 microns. An insulating layer 504 is disposed over the semiconductor substrate layer 502. The insulating layer 504 may comprise Borophosphosilicate glass (BPSG)/undoped silicon glass (USG). For example, about 6-10 KA of BPSG may be disposed atop 2-4 kA of USG to form the insulating layer 504. Further, a dielectric layer 506 is deposited above the insulating layer 504. In an example, the dielectric layer 506 is made of Tetraethyl orthosilicate (TEOS) and has a thickness of about 4-8 kA.

A Ta—Al layer 508 is fabricated on the dielectric layer 506. In an example implementation, the Ta—Al layer 508 is made of Ta—Al alloy having a composition of Tantalum in the range of about 52% to 64%. In one example, wavelength dispersive spectroscopy, wherein wave property of X-rays is used to determine quantities of elements in a given sample, is used to determine the composition of Tantalum in the Ta—Al layer 508.

The Ta—Al layer 508 is a thin film layer having a thickness of about 200 A to 500 A depending on the configuration of the printhead integrated circuit 300. In an example, the Ta—Al layer 508 is discontinuous and comprises at least a first Ta—Al layer portion 508-1 and a second Ta—Al layer portion 508-2. The first Ta—Al layer portion 508-1 forms a pull-down resistor 510 and the second Ta—Al layer portion 508-2 forms a firing resistor 512. Thus, the pull-down resistor 510 and printhead firing resistor 512 are formed on the same layer of the printhead integrated circuit 300.

While the example implementation shown in FIG. 5 shows only one pulldown resistor 510 and printhead firing resistor 512 formed on the printhead integrated circuit 300, it will be understood that such as representation is only for simplicity. The number of printhead firing resistors may be in tens of hundreds depending on the configuration of the printhead integrated circuit 300. Similarly, there may be about a couple of dozen pull-down resistors depending on the configuration of the printhead integrated circuit 300.

Although not shown in FIG. 5, as explained previously, a circuitry may fabricated on the printhead integrated circuit 300 to receive the select signal, data signal, synchronization signal, and clock signal for triggering the printhead firing resistors. Depending on which node of the circuitry the pull-down resistor 510 is connected to, the pulldown resistor 510 may be a select pull-down resistor, data pull-down resistor, synchronization pull-down resistor or clock pull-down resistor. Similarly, in case the pull-down resistor 510 is coupled to a circuitry fabricated on the printhead integrated circuit 300 to receive the ID signal for actuating the EPROM cells, the pull-down resistor 510 forms an ID pull-down resistor.

The pull-down resistor 510 fabricated of the Ta—Al layer 508 is significantly smaller in size as opposed to a pull-down resistor made of polysilicon, for instance. To illustrate, consider the pull-down resistor 510 to be a select pull-down resistor having a resistance of about 10KΩ. Polysilicon has a sheet resistivity of about 30 Ω/sq while the Ta—Al thin film layer has a sheet resistivity of about 120 Ω/sq in an example. The area on the semiconductor substrate layer 502, occupied by the pull-down resistor 510 formed of Ta—Al thin film layer is about 4500-5000 $\mu m^2$ while that occupied by the select pull-down resistor formed using polysilicon is about 19240 $\mu m^2$. Thus, use of the Ta—Al thin film layer provides about 75% reduction in the area used by the resistor.

In another example, the pull-down resistor 510 may be considered to be an ID pull-down resistor of about 100KΩ. Accordingly, in the present example, the ID pull-down resistor takes an area of about 51000-52000 $\mu m^2$. If an ID pull-down resistor of about 100KΩ were made of polysilicon, the area would be around 205000 $\mu m^2$. Again, use of the Ta—Al thin film layer provides about 75% reduction in the area used by the resistor.

In some example implementations, the Ta—Al thin film layer may have a sheet resistivity of about 60 Ω/sq. Using such a Ta—Al thin film layer to fabricate the pull-down resistor 510 leads to a reduction of about 50% in the area occupied by a pull-down resistor made of polysilicon.

Figure 6:
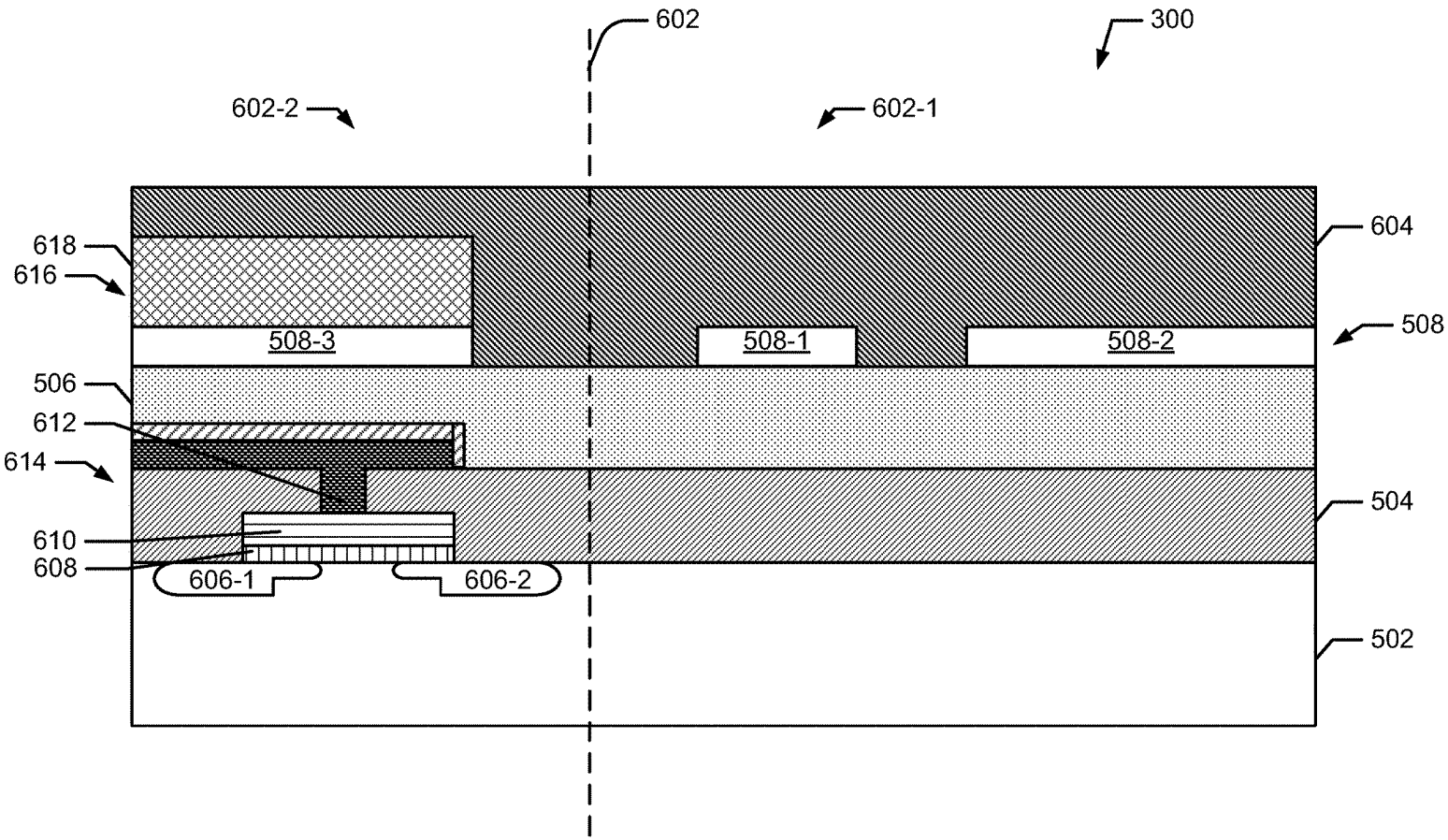
FIG. 6 illustrates a cross-sectional view depicting various layers of the printhead integrated circuit, in accordance with another example implementation of the present subject matter.

FIG. 6 illustrates a cross-sectional view depicting various layers of the printhead integrated circuit 300, in accordance with another example implementation of the present subject matter. In the example shown in FIG. 6 the pull-down resistor 510 forms an ID pull-down resistor.

A vertical line 602 is shown to divide the cross-sectional view of FIG. 6 into two parts. The part 602-1 on the right hand side, shows the discontinuous Ta—Al layer 508 comprises the first Ta—Al layer portion 508-1 and the second Ta—Al layer portion 508-2. A passivation layer 604 is provided over the Ta—Al layer 508 to surround the first Ta—Al layer portion 508-1 and the second Ta—Al layer portion 508-2 to electrically isolate the two.

In accordance with the example implementation shown in FIG. 6, the pull-down resistor 510 that is formed by the layer portion 508-1 forms an ID pull-down resistor and accordingly the part 602-2 on the left hand side of the vertical line 602 shows an EPROM cell to which the ID pull-down resistor may be coupled. Again, for the ease of depiction, FIG. 6 shows one EPROM cell. Numerous other EPROM cells and other components that may be included in the memory array have not been shown.

In an example, the EPROM cell includes the semiconductor substrate layer 502 having a first n-doped region 606-1 and a second n-doped region 606-2. The first n-doped region 606-1 may form a source region and the second n-doped region 606-2 may form a drain region of the EMROM cell.

A first dielectric layer 608 is provided atop the semiconductor substrate layer 502. In an example, the first dielectric layer 608 may be an oxide layer. The oxide layer may include, for example, silicon dioxide and may have thickness of about 400-900 angstroms (A) in one example. The first dielectric layer 608 is followed by a semiconductive polysilicon layer 610 which is in turn electrically connected to a first conductive metal layer 612. The semiconductive polysilicon layer 610 and the first conductive metal layer 612 together make a first conductive layer 614 of the EPROM cell. The first conductive layer 614 is the floating gate of the EPROM cell.

The semiconductive polysilicon layer 610 forms a polygate layer and may have a thickness of about 2500-4000 A in one example. The first conductive metal layer 612 may, in one example, include aluminum copper silicon (AlCuSi), tantalum aluminum (TaAl), or aluminum copper (Alcu), and may have a thickness of about 2-6 kA.

The first dielectric layer 608 capacitively couples the first conductive layer 614 to the semiconductor substrate layer 302. In a similar manner, the dielectric layer 506 is provided as a second dielectric layer to capacitively couple the first conductive layer 614 to a second conductive layer 616. Further, in an example implementation, the second conductive layer 616 may include a third Ta—Al layer portion 508-3 and an Al—Cu layer 618. It will be understood that the third Ta—Al layer portion 508-3 is fabricated of the discontinuous Ta—Al layer 508 and has as thickness of 200-500 A as previously mentioned. The Al—Cu layer 618 has as thickness of about 4 k-15 kA in an example. The second conductive layer 616 corresponds to an input gate of the EPROM cell.

In an example, the first Ta—Al layer portion 508-1, the second Ta—Al layer portion 508-2 and the third Ta—Al layer portion 508-3 may be fabricated with the Al—Cu layer 618 disposed above. The Al—Cu layer 618 may then be etched away from the first Ta—Al layer portion 508-1 and the second Ta—Al layer portion 508-2 while retaining the same above the third Ta—Al layer portion 508-3. The third Ta—Al layer portion 508-3 along with the Al—Cu layer 618 forms the second conductive layer 616 of the EPROM cell while the first Ta—Al layer portion 508-1 and the second Ta—Al layer portion 508-2 form the ID pull-down resistor and the printhead firing resistor, respectively.

As mentioned previously, generally, the pull-down resistors of the printhead integrated circuit 300 are made of polysilicon. For instance, the ID pull-down resistor is generally formed in the semiconductive polysilicon layer 610. The semiconductive polysilicon layer 610 has a thickness of about 2500-4000 A and accordingly, the ID pull-down resistor fabricated of the semiconductive polysilicon layer 610 is significantly thicker when compared to an ID pull-down resistor fabricated of the Ta—Al layer 508 having a thickness of about 200-500 A. The compactness of the Ta—Al pull-down resistors allow better planning of the topology of the printhead integrated circuit 300.

Further, in some example implementations, a barrier layer (not shown) is provided over the passivation layer 604 to laminate the passivation layer 604. The significantly less thickness of the Ta—Al layer 508 causes the passivation layer 604 above the Ta—Al layer 508 to be more planar. This is turn enhances the adhesion of the passivation layer 604 to the barrier layer.

Though not depicted, the printhead integrated circuit 300 comprises a plurality of first Ta—Al layer portions and the second Ta—Al layer portions. The first Ta—Al layer portions form the various pull-down resistors as described above and the second Ta—Al layer portions form the numerous printhead firing resistors of the printhead integrated circuit 300.

Although implementations for printhead assemblies and integrated circuits for printhead assemblies have been described in a language specific to structural features and/or methods, it would be understood that the appended claims are not necessarily limited to the specific features or methods described. Rather, the specific features and methods are disclosed as example implementations for integrated circuits for printhead assemblies.

What is claimed is:

1. An integrated circuit for a printhead assembly comprising:

a semiconductor substrate;

at least one nozzle array comprising printhead firing resistors fabricated on the semiconductor substrate;

a print control circuit formed on the semiconductor substrate to provide firing control signals to the printhead firing resistors based on print control signals received from an electronic controller, the print control circuit further comprising pull-down resistors to set a level of each of the print control signals at a predefined logic level when the print control circuit is in a high impedance state, wherein each of the pull-down resistors is fabricated of Tantalum-Aluminum (Ta—Al);

a memory array comprising erasable programmable read-only memory (EPROM) cells formed on the semiconductor substrate; and a memory addressing circuit fabricated on the semiconductor substrate to perform read and write operations on the EPROM cells based on a memory control signal received from the electronic controller, the memory addressing circuit comprising a pull-down resistor to set a level of the memory control signal at a predefined logic level when the memory addressing circuit is in a high impedance state, wherein the pull-down resistor is fabricated of Ta—Al.

2. The integrated circuit for the printhead assembly as claimed in claim 1, wherein the pull-down resistors of the print control circuit and the pull-down resistor of the memory addressing circuit are formed on the same layer of the integrated circuit as the printhead firing resistors.

3. The integrated circuit for the printhead assembly as claimed in claim 1, wherein at least one of the pull-down resistors is to set the level for a select signal, wherein the select signal is to selectively enable a printhead firing resistor, from amongst the printhead firing resistors.

4. The integrated circuit for the printhead assembly as claimed in claim 1, wherein at least one of the pull-down resistors is to set the level for a data signal, the data signal being representative of data to be printed.

5. The integrated circuit for the printhead assembly as claimed in claim 1, wherein at least one of the pull-down resistors is to set the level for a synchronization signal, wherein the synchronization signal is to enable sequential addressing of the printhead firing resistors.

6. The integrated circuit for the printhead assembly as claimed in claim 1, wherein one of the pull-down resistors is to set the level for a clock signal received by the print control circuit.

7. A printhead assembly comprising:

a plurality of print nozzles in a nozzle array, wherein each of the plurality of print nozzles is coupled to a printhead firing resistor, the printhead firing resistor being individually addressable; and a print control circuit to actuate the printhead firing resistor;

wherein the print control circuit comprises pull-down resistors made of Tantalum-Aluminum (Ta—Al).

8. The printhead assembly as claimed in claim 7, wherein to actuate the printhead firing resistor, the print control circuit is to receive a select signal, data signal, synchronization signal and clock signal, from an electronic controller, and wherein the pull-down resistors are to set a predefined logic level for the select signal, data signal, synchronization signal and clock signal in a high impedance state of the print control circuit.

9. The printhead assembly as claimed in claim 8 further comprising:

a memory array, wherein the memory array is to receive a memory control signal from the electronic controller; and at least one pull-down resistor, coupled to the memory array, to set a level of the memory control signal at a predefined logic level when the memory array is in a high impedance state, wherein the at least one pull-down resistor is made of Ta—Al.

10. The printhead integrated circuit comprising:

a semiconductor substrate layer;

an insulating layer superimposed on the semiconductor substrate layer;

a dielectric layer atop the insulating layer; and a Tantalum-Aluminum (Ta—Al) layer disposed over the dielectric layer, the Ta—Al layer being discontinuous and comprising at least a first Ta—Al layer portion and a second Ta—Al layer portion, wherein the first Ta—Al layer portion forms a pull-down resistor and the second Ta—Al layer portion forms a firing resistor.

11. The printhead integrated circuit as claimed in claim 10, wherein the Ta—Al layer is made of Ta—Al alloy having a composition of Tantalum in the range of about 52% to 64%.

12. The printhead integrated circuit as claimed in claim 10, wherein the Ta—Al layer is a thin film layer having a thickness of about 200 A to 500 A and sheet resistivity of one of about 120 Ω/sq and about 60 Ω/sq.

13. The printhead integrated circuit as claimed in claim 10, wherein the first Ta—Al layer portion is coupled to a circuitry fabricated on the printhead integrated circuit to receive a select signal, data signal, synchronization signal, and clock signal, to generate firing control signals to actuate the firing resistor.

14. The printhead integrated circuit as claimed in claim 13, wherein the first Ta—Al layer portion is coupled to the circuitry to receive the select signal and wherein the first Ta—Al layer portion has a resistance of about 10KΩ to 100 KΩ.

15. The printhead integrated circuit as claimed in claim 10 further comprising:

an array of erasable programmable read-only memory (EPROM) cells fabricated on the printhead integrated circuit to store identification information relating to printhead integrated circuit, wherein the identification information is retrievable by an electronic controller of a printer to which the printhead integrated circuit is coupled, wherein the first Ta—Al layer portion is coupled to the array of EPROM cells and wherein the first Ta—Al layer portion has a resistance of about 100 KΩ.

* * * * *